US008376414B2

(12) United States Patent
Nakanishi et al.

(10) Patent No.: US 8,376,414 B2
(45) Date of Patent: Feb. 19, 2013

(54) TWO-POINT LOCK FOR SLIDING DOOR

(75) Inventors: Yoshikazu Nakanishi, Tokyo (JP); Manabu Shimoji, Tokyo (JP)

(73) Assignee: Truth Hardware Corporation, Owatonna, MN (US)

( * ) Notice: Subject to any disclaimer, the term of this patent is extended or adjusted under 35 U.S.C. 154(b) by 863 days.

(21) Appl. No.: 12/098,139

(22) Filed: Apr. 4, 2008

(65) Prior Publication Data

US 2008/0265587 A1 Oct. 30, 2008

Related U.S. Application Data

(60) Provisional application No. 60/922,166, filed on Apr. 6, 2007, provisional application No. 60/944,259, filed on Jun. 15, 2007.

(51) Int. Cl.
*E05C 9/16* (2006.01)
*E05C 19/10* (2006.01)

(52) U.S. Cl. ..... 292/26; 292/97; 292/DIG. 46; 292/DIG. 60; 70/95; 70/100

(58) Field of Classification Search ..... 292/11, 292/24–27, 44, 45, 47, 48, 56, 109, 110, 292/112, 116, 194–196, 240, DIG. 46, DIG. 60, 292/5, 28, 31, 95–97, 121, 123; 70/95, 100
See application file for complete search history.

(56) References Cited

U.S. PATENT DOCUMENTS

| | | | | |
|---|---|---|---|---|
| 2,701,156 | A * | 2/1955 | Palmer, Jr. | 292/113 |
| 2,736,185 | A * | 2/1956 | Collar | 70/100 |
| 2,789,852 | A * | 4/1957 | Eads | 292/110 |
| 3,105,711 | A * | 10/1963 | Woodworth et al. | 292/113 |
| 3,958,822 | A | 5/1976 | Germer | |
| 4,050,272 | A * | 9/1977 | Tanaka | 70/100 |
| 4,341,407 | A | 7/1982 | Zankich | |
| 4,877,274 | A | 10/1989 | Poe | |
| 5,595,409 | A * | 1/1997 | Fier et al. | 292/112 |
| 5,820,170 | A | 10/1998 | Clancy | |
| 6,152,498 | A | 11/2000 | Lindqvist | |
| 6,264,252 | B1 * | 7/2001 | Clancy | 292/196 |
| 6,672,632 | B1 * | 1/2004 | Speed et al. | 292/25 |
| 6,688,656 | B1 | 2/2004 | Becken | |
| 6,776,441 | B2 * | 8/2004 | Liu | 292/26 |
| 6,871,451 | B2 | 3/2005 | Harger | |
| 6,945,572 | B1 | 9/2005 | Hauber | |
| 6,981,724 | B2 | 1/2006 | Denys | |

(Continued)

FOREIGN PATENT DOCUMENTS

GB 2196375 A * 4/1988

OTHER PUBLICATIONS

Search Report/Written Opinion for International Application No. PCT/US2008/004409, Dated Oct. 26, 2009.

(Continued)

*Primary Examiner* — Carlos Lugo
*Assistant Examiner* — Alyson M Merlino
(74) *Attorney, Agent, or Firm* — Patterson Thuente Christensen Pedersen, P.A.

(57) ABSTRACT

A multi-point latch assembly having a single adjustment point for shifting the position of two or more latching members. The latch mechanism includes a housing and a carrier assembly received in the housing. The carrier assembly includes a pair of latch hooks. A carrier position adjustment assembly operably couples the housing and the carrier assembly such that the carrier assembly is selectively shiftable in the housing with the carrier position adjustment assembly to alter the distance the latch hooks protrude from the housing when the latch hooks are positioned in the second position. An anti-slam mechanism may also be coupled with the carrier, and may be selectively shiftable with the same adjustment mechanism.

14 Claims, 18 Drawing Sheets

U.S. PATENT DOCUMENTS

| | | | | |
|---|---|---|---|---|
| 7,040,671 | B2 * | 5/2006 | Su et al. | 292/24 |
| 7,178,839 | B2 * | 2/2007 | Tsai | 292/51 |
| 7,261,330 | B1 * | 8/2007 | Hauber | 292/97 |
| 7,604,265 | B2 * | 10/2009 | Tsai | 292/26 |
| 2006/0071478 | A1 * | 4/2006 | Denys | 292/26 |
| 2006/0076783 | A1 * | 4/2006 | Tsai | 292/24 |
| 2006/0119108 | A1 * | 6/2006 | Heid et al. | 292/97 |

OTHER PUBLICATIONS

PCT Search Report mailed Sep. 8, 2008, for International Publication No. PCT/US2008/004409, 2 Pgs.

Office Action Issued by the Canadian Patent Office related to Canadian Application No. 2,628,518, Dated Jul. 18, 2011.

* cited by examiner

TWO-POINT LOCK FOR SLIDING DOOR

RELATED APPLICATIONS

This application claims the benefit of U.S. Provisional Application No. 60/922,166, entitled TWO-POINT LOCK FOR SLIDING DOOR, filed Apr. 6, 2007, and also claims the benefit of U.S. Provisional Application No. 60/944,259, entitled MULTI-POINT LOCK MECHANISM, filed Jun. 15, 2007, said applications being hereby fully incorporated herein by reference.

FIELD OF THE INVENTION

This invention relates to adjustable lock mechanisms for sliding doors. More particularly, a two-point lock of the present disclosure provides for a single point of adjustment for varying the position of two locking members.

BACKGROUND OF THE INVENTION

In a typical sliding door installation, such as sliding patio doors, the door is latched by a mechanism mounted in the locked face of the stile of a sliding door. In a single-point latch mechanism, a single hook, or other latching component engages a receiving (keeper) component disposed in the door jamb to latch the door and maintain the door in a latched state. While single-point latch mechanisms often provide satisfactory performance, the use of a single hook often fails to provide the security desired by a homeowner.

In response to the desire for increased security by homeowners, multi-point latch mechanisms have been developed for use in sliding door installations. These multi-point mechanisms can be mounted in the locked face of the stile of the sliding door with multiple latching elements engaging a receiving structure mounted on door jambs. These multi-point latches increase the security of the latch mechanisms by providing additional locking strength, thereby diminishing the likelihood of forced entry.

A typical problem arising during installation of sliding door latches is that the latch elements may not securely engage with the keeper due to variations in construction. In these cases it is desirable to adjust the position of the latch elements, particularly the distance by which the latch elements project from the mechanism, or the keeper or both to attain secure engagement. Prior multi-point latch mechanisms, however, have sometimes included no adjustment mechanism at all for the latch elements, or have included complicated mechanisms requiring separate adjustments for each latching point. Further, while previous attempts have been made to provide a multi-point latch mechanism with a single adjustment point for simultaneously adjusting the position of more than one of the latch points, these attempts have resulted in mechanisms in which the adjustment mechanism shifts one latch point more than another. The result is still less than ideal latch engagement.

A further drawback of known adjustable multi-point latch mechanisms is that the range of adjustment of the mechanism is typically not visually evident. Hence, it cannot be readily determined whether the device is at or near one of the limits of travel without actually operating the adjustment until the limit is reached.

Thus, there still exists a need in the industry for a multi-point latch assembly that not only increases security, but which provides for quick and easy adjustment of the latches for proper engagement with the receiving structure.

SUMMARY OF THE INVENTION

Embodiments of the invention substantially meet the aforementioned need of the industry by providing a multi-point latch assembly having a single adjustment point for varying the position of one or more latching members.

In an embodiment of the invention, a sliding door assembly includes a door frame defining an opening, and a door slidably shiftable in a track on the door frame to open and close the opening defined by the door frame. The door includes a vertically oriented stile having a mortise in an edge thereof. A latch assembly is received in the mortise, the latch assembly including a housing and a carrier assembly received in the housing. The carrier assembly includes a pair of latch hooks with an actuator linkage operably coupled thereto. The latch hooks are selectively shiftable with the actuator linkage between a first position in which the latch hooks are substantially within the housing and a second position in which a portion of each of the latch hooks protrudes substantially the same distance from the housing to engage the door frame. The latch assembly further includes a carrier position adjustment assembly operably coupling the housing and the carrier assembly. The carrier assembly is selectively shiftable in the housing with the carrier position adjustment assembly to alter the distance the latch hooks protrude from the housing when the latch hooks are positioned in the second position.

In further embodiments, the carrier assembly may include an anti-slam mechanism. The anti-slam mechanism may include a button that protrudes from the housing, and the anti-slam mechanism may be shiftable with the carrier position adjustment assembly to alter a distance the button protrudes from the housing.

In further embodiments, the carrier position adjustment assembly may include a rotatable screw. The carrier position adjustment assembly may include a visual indicator for indicating the position of the carrier relative to the limits of travel of the carrier. The housing may define an elongate aperture for accessing the rotatable screw, and the position of the rotatable screw within the elongate aperture may comprise the visual indicator for indicating the position of the carrier relative to the limits of travel of the carrier.

In a further embodiment, a latch mechanism for a sliding door includes a housing and a carrier assembly received in the housing. The carrier assembly includes a pair of latch hooks with an actuator linkage operably coupled thereto, the latch hooks being selectively shiftable with the actuator linkage between a first position in which the latch hooks are substantially within the housing and a second position in which a portion of each of the latch hooks protrudes substantially the same distance from the housing. The latch mechanism further includes a carrier position adjustment assembly operably coupling the housing and the carrier assembly, the carrier assembly selectively shiftable in the housing with the carrier position adjustment assembly to alter the distance the latch hooks protrude from the housing when the latch hooks are positioned in the second position.

In further embodiments, a latch mechanism for a sliding door includes a housing and a carrier assembly received in the housing. The carrier assembly includes a pair of latch hooks with an actuator linkage operably coupled thereto, the latch hooks being selectively shiftable with the actuator linkage between a first position in which the latch hooks are substantially within the housing and a second position in which a portion of each of the latch hooks protrudes substantially the same distance from the housing. The latch mechanism further includes means for selectively shifting the carrier assembly in the housing to alter the distance the latch hooks protrude from the housing when the latch hooks are positioned in the second position. The means for selectively shifting the carrier assembly in the housing may include means for indicating the position of the carrier relative to the limits of travel of the carrier.

Hence, in embodiments of the invention, a multi-point latch assembly provides a single adjustment point for adjusting positions of two or more latching members.

Embodiments of the invention may include a method for adjusting the position of a pair of latching members using a single adjustment member. The method may further include providing a visual display of the position of the carrier relative to the limits of travel of the carrier, for example by displaying a position of the single adjustment member within a visible access channel. The method can further include resisting external forces placed on the latching members by providing opposed angled channels on a fixed outer housing and a movable inner housing so as to limit movement of the latching members to situations in which the single adjustment member is manipulated.

In embodiments of the invention, a multi-point latch assembly provides for operation of the latch with a single input member.

In embodiments of the invention, a multi-point latch assembly includes an anti-slam mechanism adjustable in position with a carrier position adjustment mechanism that also adjusts the position of two or more latching members.

Throughout the specification, any references to such relative terms as top and bottom, and the like, are intended for convenience of description and are not intended to limit the present invention or its components to any one positional or spatial orientation. It will be further understood that various dimensions of the components in the attached figures may vary depending upon specific applications and intended use of the invention without departing from the scope of the invention.

The above summary of various embodiments of the invention is not intended to describe each illustrated embodiment or every implementation of the invention. Rather, the embodiments are chosen and described so that others skilled in the art may appreciate and understand the principles and practices of the invention. The figures and the detailed description that follow more particularly exemplify these embodiments.

BRIEF DESCRIPTION OF THE DRAWINGS

The invention may be more completely understood in consideration of the following detailed description of various embodiments of the invention in connection with the following drawings, in which.

Figure 1:
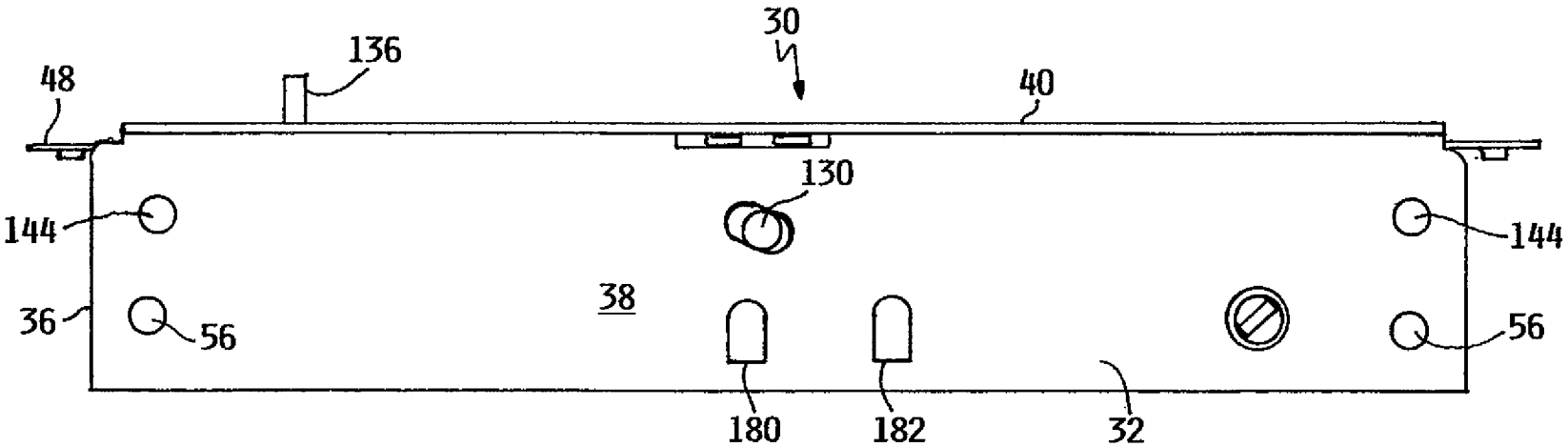
FIG. 1 is a side view of a multi-point latch assembly according to an embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE PREFERRED EMBODIMENTS

Figure 1A:
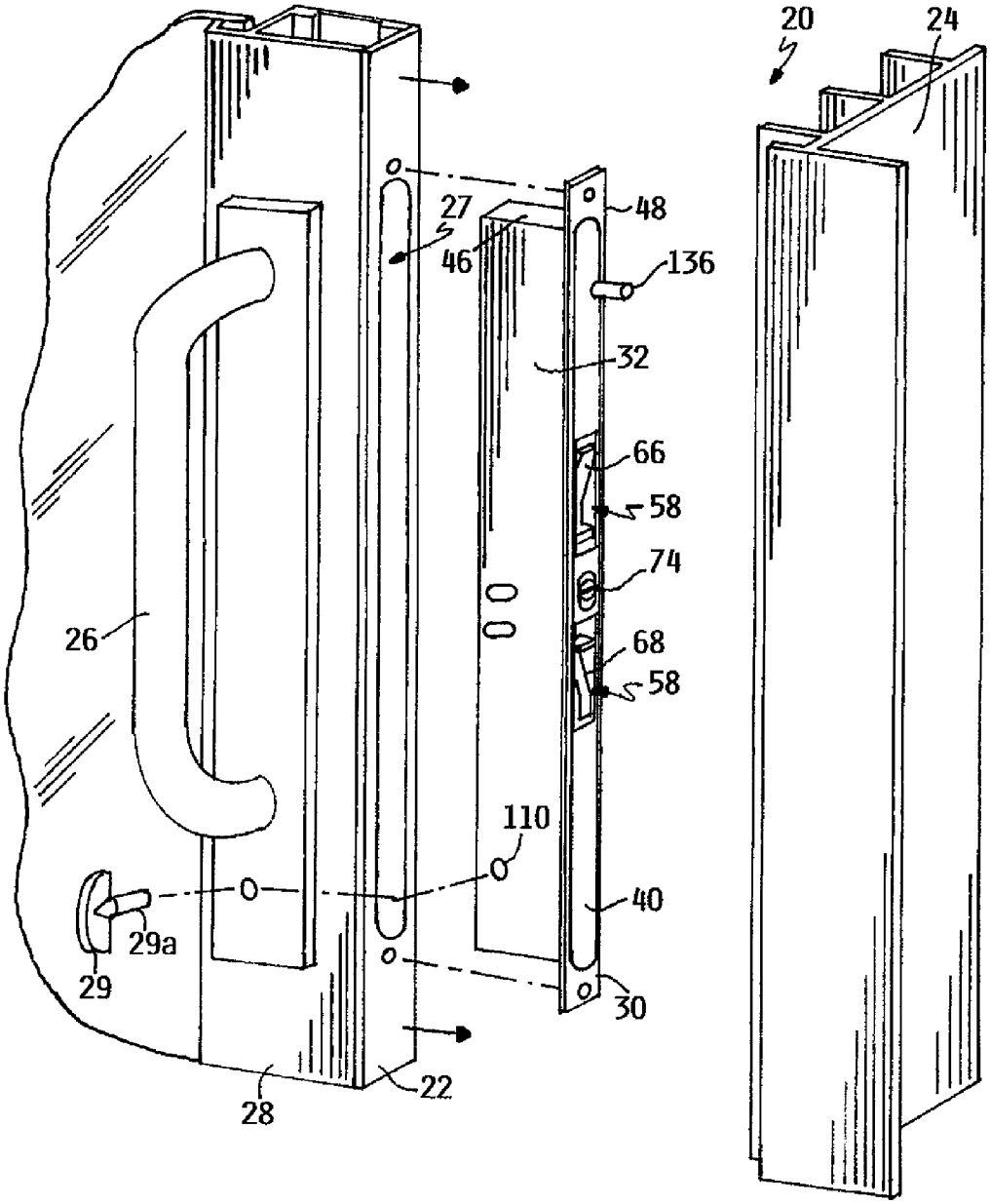
FIG. 1*a* is a fragmentary exploded perspective view of a sliding door with a multi-point latch assembly according to an embodiment of the present invention.

A sliding door assembly 20 with a latch assembly according to embodiments of the invention is depicted generally in FIG. 1*a*. Sliding door assembly 20 generally includes door 22, frame 24, handle assembly 26 and latch assembly 30. Door 22 is generally slidable in the direction of the arrows in tracks (not depicted) attached to frame 24 as is well known in the art. As depicted, latch assembly 30 is received in a mortise 27 in a vertical stile 28 of door 22. A thumb turn 29 or other control having a tang 29*a* actuates latch assembly 30 as further described hereinbelow.

Latch assembly 30 according to an embodiment of the invention is depicted generally in FIGS. 1-18. The various components of latch assembly 30 may be formed from suitably durable materials including, for example, metals such as carbon steel, stainless steel, aluminum, and combinations thereof, or other materials such as high strength polymers and the like. Latch assembly 30 generally includes housing 32 and carrier assembly 34. Housing 32 generally includes housing body 36, cover plate 38, and front escutcheon plate 40. Housing body 36 generally includes wall 42, opposing side walls 44, 46, and front wall 48. Cover plate 38 defines guide slots 50, actuator aperture 52, and apertures 54 for receiving fasteners 56 to fasten cover plate 38 to housing body 36. Front escutcheon plate 40 defines hook ports 58 and adjustment screw aperture 60. Front escutcheon plate 40 is fastened to front wall 48 with fasteners 62.

Carrier assembly 34 generally includes carrier housing 64, hook bolts 66, 68, actuator slide plate 70, actuator linkage 72, carrier position adjustment assembly 74, and anti-slam assembly 76. Carrier housing 64 generally includes a pair of carrier housing halves 78, 80. Carrier housing half 78 generally includes planar portion 82 with a projecting flange 84. Carrier housing half 80 generally includes wall 86, rear wall 88, opposing side walls 90, 92, and front wall 94.

Figure 10:
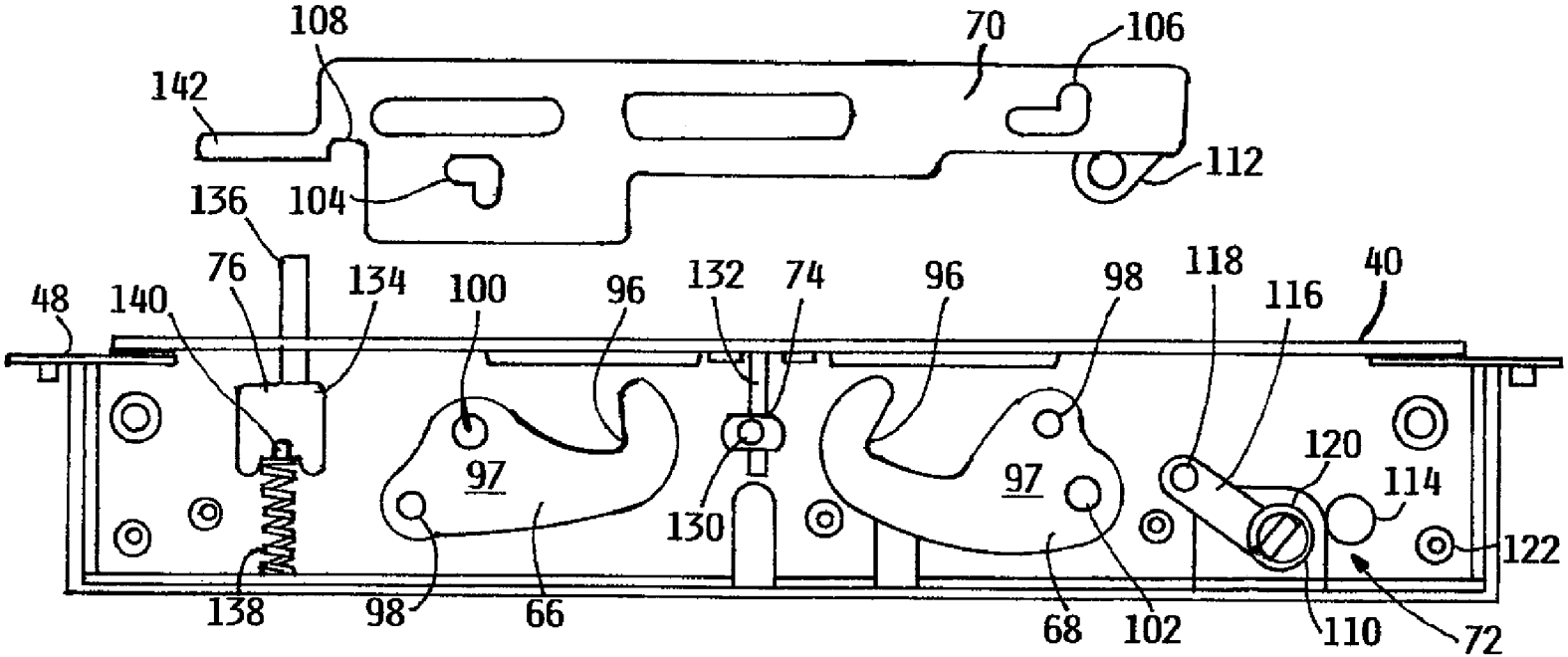
FIG. 10 is a side view of the multi-point latch assembly of FIG. 4 with the actuator slide plate removed to expose underlying portions of the mechanism.
Figure 11:
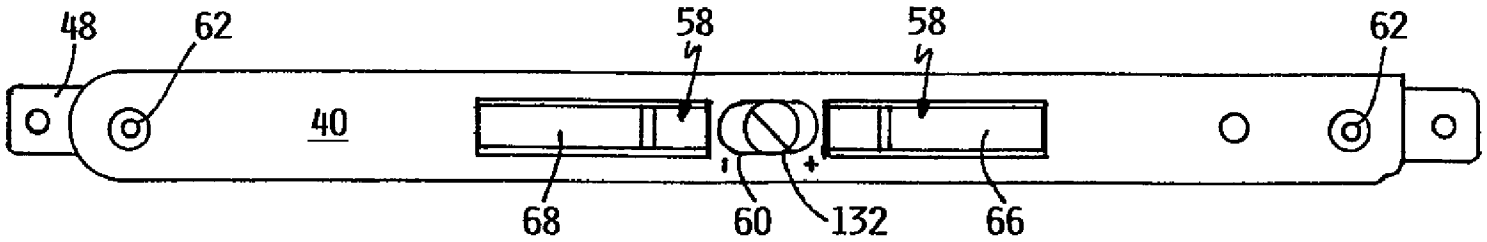
FIG. 11 is a front view of the multi-point latch assembly of FIG. 1.
Figure 12:
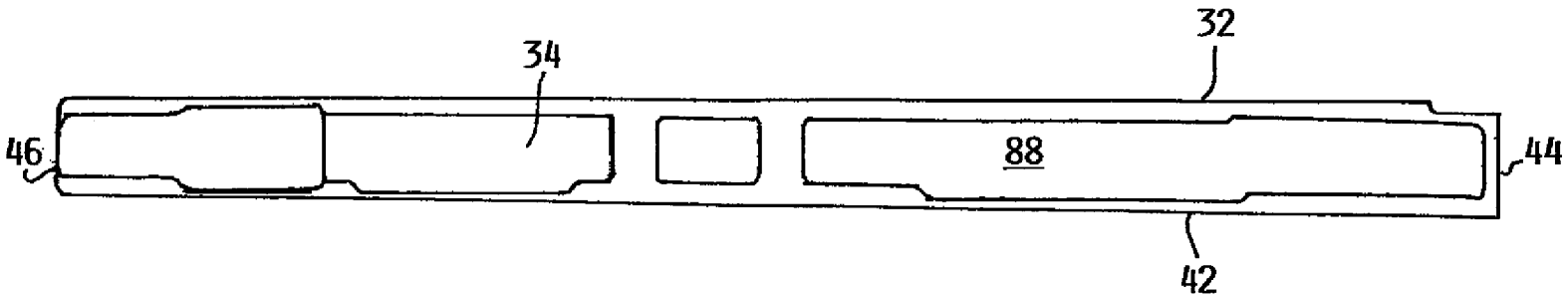
FIG. 12 is a rear view of the multi-point latch assembly of FIG. 1.
Figure 13:
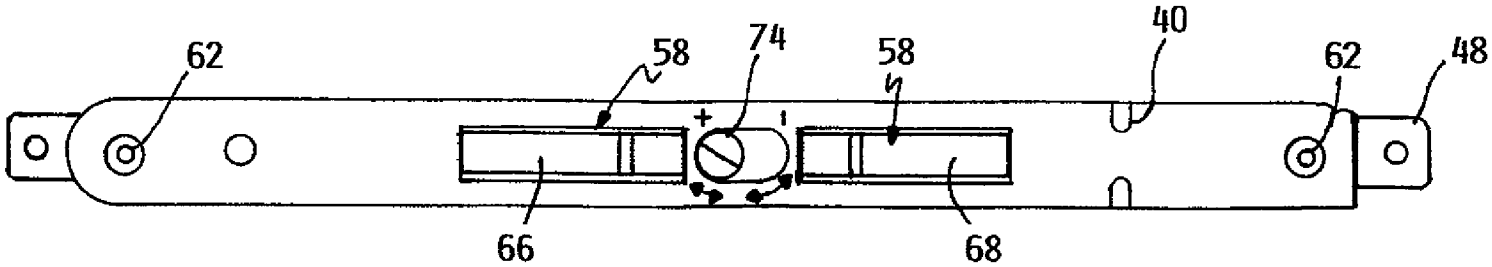
FIG. 13 is a front view of the multi-point latch assembly of FIG. 1 depicting the latch assembly with the carrier at one of the limits of travel.
Figure 14:
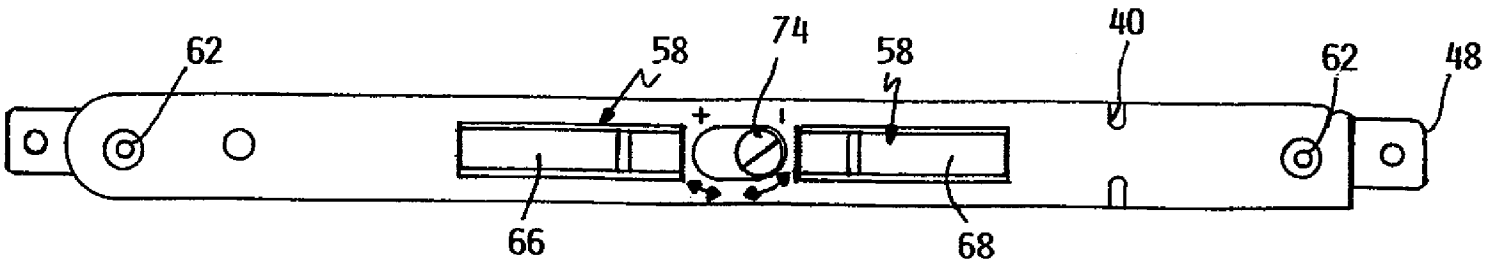
FIG. 14 is a front view of the multi-point latch assembly of FIG. 1 depicting the latch assembly with the carrier at the limit of travel opposite that depicted in FIG. 13.
Figure 15:
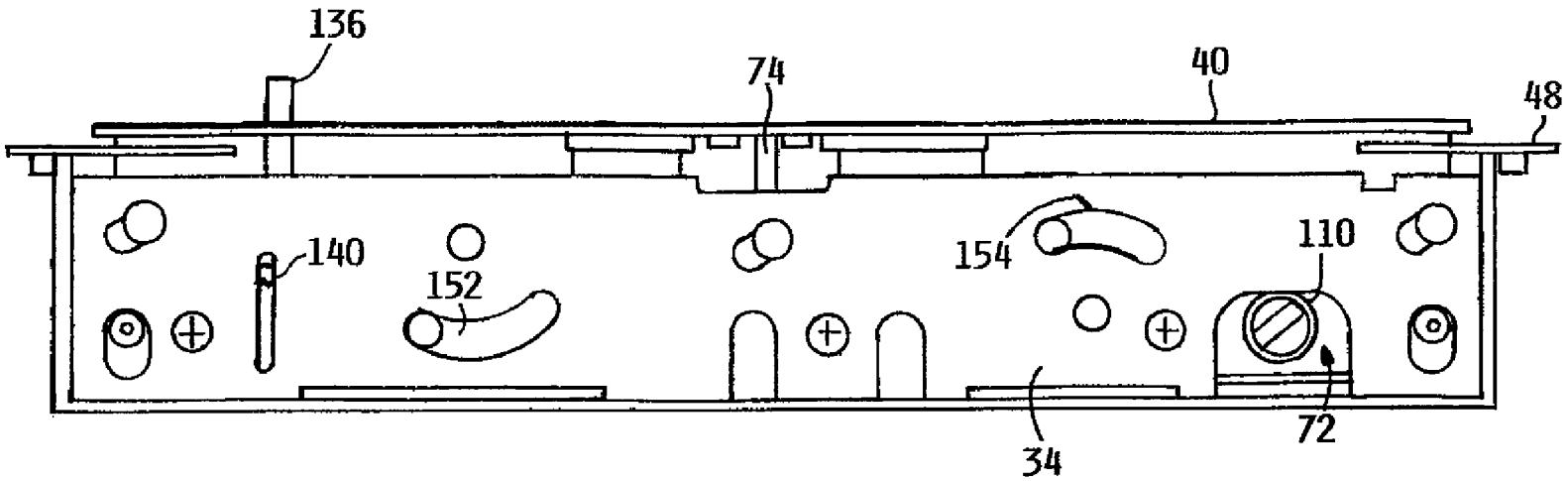
FIG. 15 is a side view of the multi-point latch assembly of FIG. 1 with the carrier positioned in a position away from the front of the housing and the latch hooks in a fully retracted position.
Figure 16:
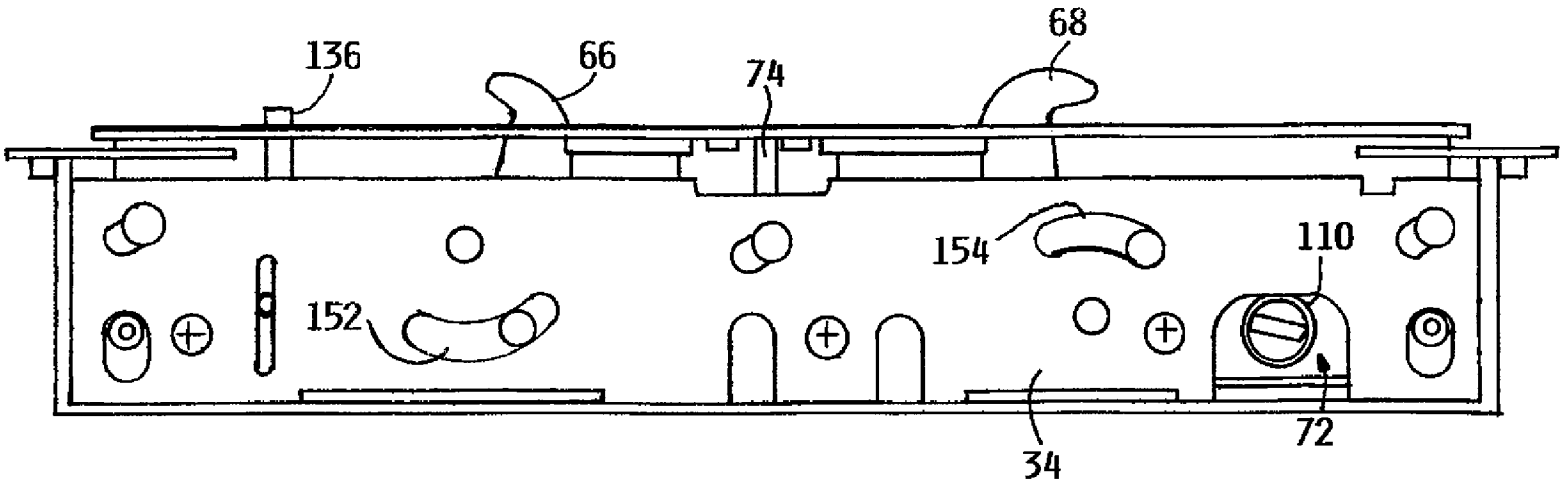
FIG. 16 is a side view of the multi-point latch assembly of FIG. 1 with the carrier positioned in a position away from the front of the housing and the latch hooks in an intermediate position.

Each hook bolt 66, 68, generally includes hook portion 96 and body portion 97. Actuator pin 98 projects from body portion 97 of each hook bolt 66, 68. As depicted in FIG. 10, hook bolts 66, 68, are pivotally attached to wall 86 of carrier housing half 80 at pivots 100, 102, respectively.

Actuator slide plate 70 defines two generally L-shaped hook actuator slots 104, 106, and anti-slam notch 108. Actuator linkage 72 generally includes cylinder 110, link 112, and spring 114. Cylinder 110 includes projecting link arm 116 having coupling pin 118. Spring 114 extends between lobe 120 of cylinder 110 and fastener boss 122 which extends from wall 42 of housing body 36. Link arm 116 is pivotally coupled to link 112 at pivot 124, and link 112 is pivotally coupled to actuator slide plate 70 at pivot 126. Cylinder 110 defines key hole 128 for receiving actuator tang 29*a*.

Means for selectively shifting the carrier in the form of carrier position adjustment assembly 74 generally includes post 130 and screw 132. Post 130 is fixed to retainer plate 133 on the exterior of wall 42 of housing body 36 as further disclosed hereinafter. Screw 132 threads through an aperture in post 130.

Anti slam assembly 76 generally includes block portion 134, button 136 and spring 138. Block portion 134 has projecting tab 140. Spring 138 extends between block portion 134 and rear wall 88 of carrier housing half 80 and biases block portion 134 so that button 136 protrudes from front escutcheon plate 40.

Figure 4:
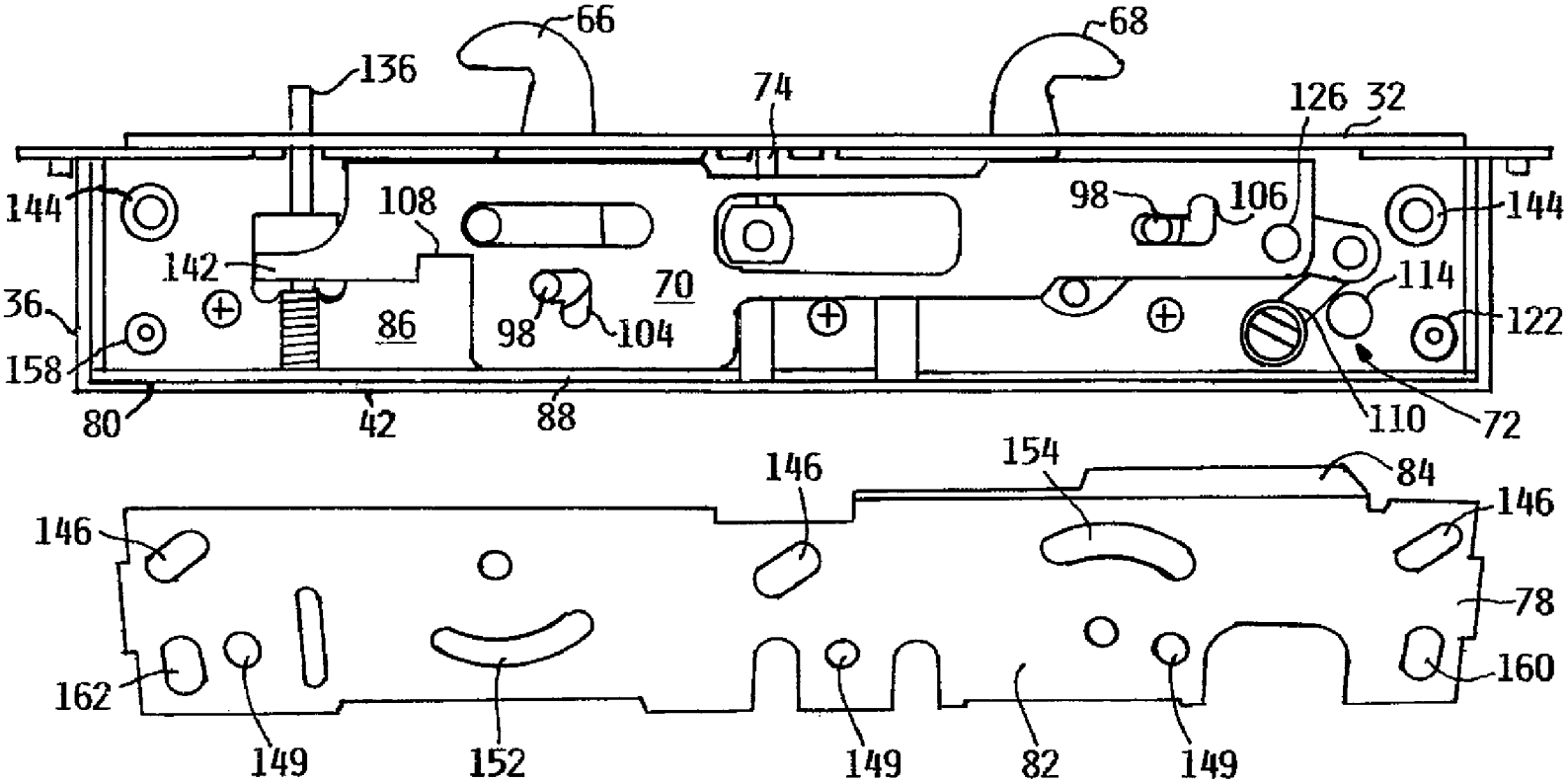
FIG. 4 is a side view of the multi-point latch assembly of FIG. 2 with a portion of the carrier assembly housing removed to expose the interior of the carrier assembly.
Figure 5:
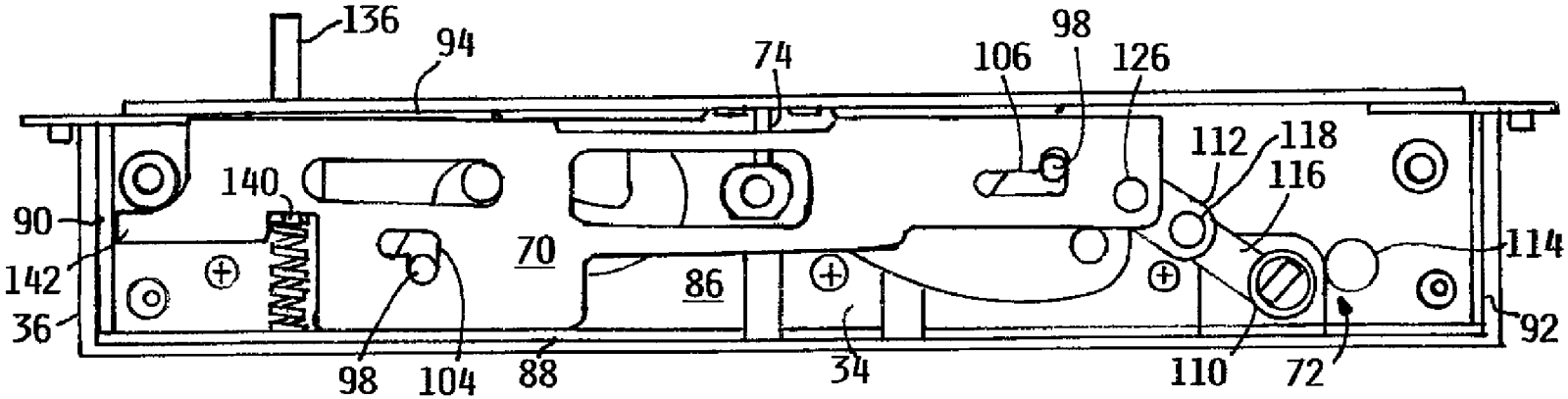
FIG. 5 is a side view of the multi-point latch assembly of FIG. 4 with the carrier assembly shifted at its limit of travel in a direction toward the front side of the housing.
Figure 6:
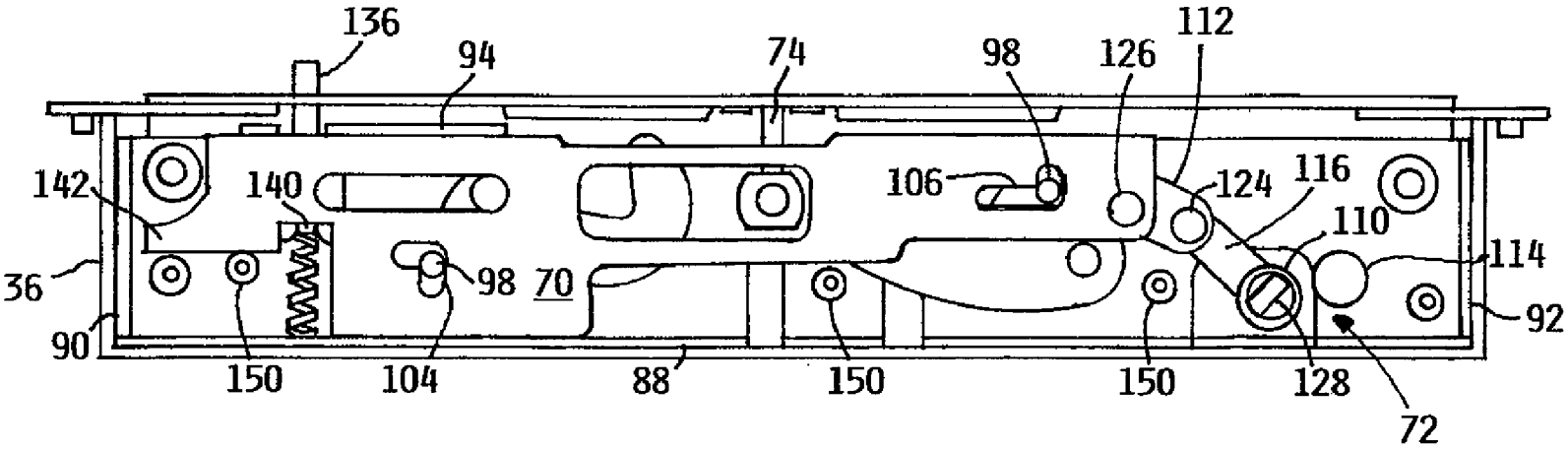
FIG. 6 is a side view of the multi-point latch assembly of FIG. 4 with the carrier assembly shifted at its limit of travel in a direction away from the front side of the housing.
Figure 7:
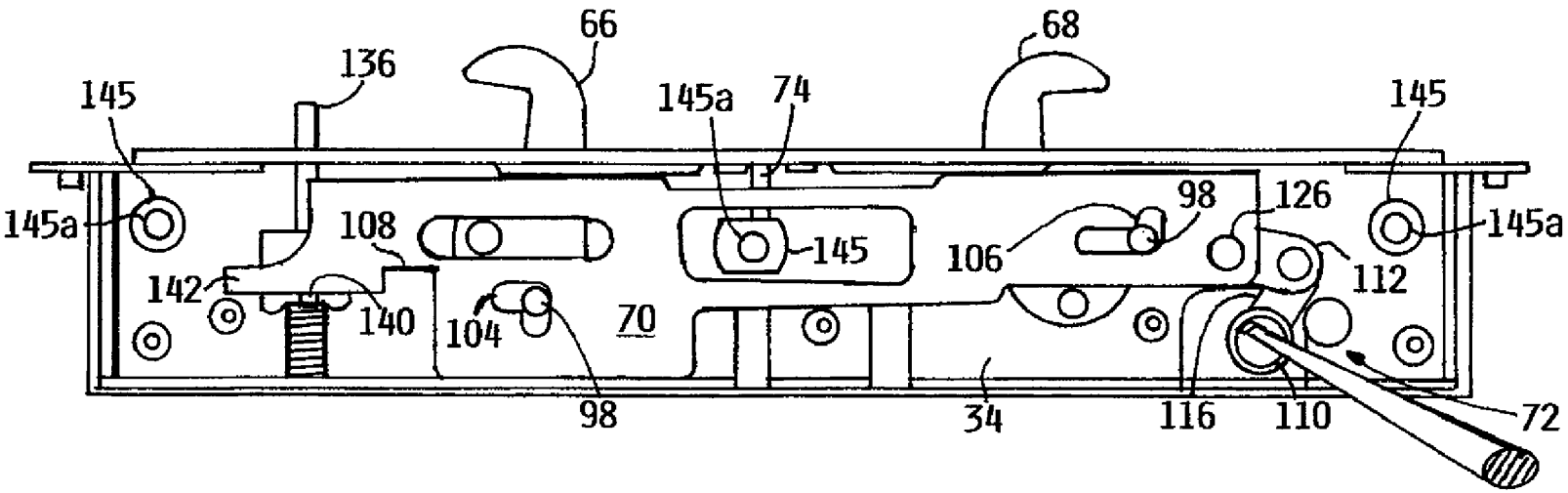
FIG. 7 is a side view of the multi-point latch assembly of FIG. 4 depicting the mechanism at an intermediate position during operation of the latch hooks.
Figure 8:
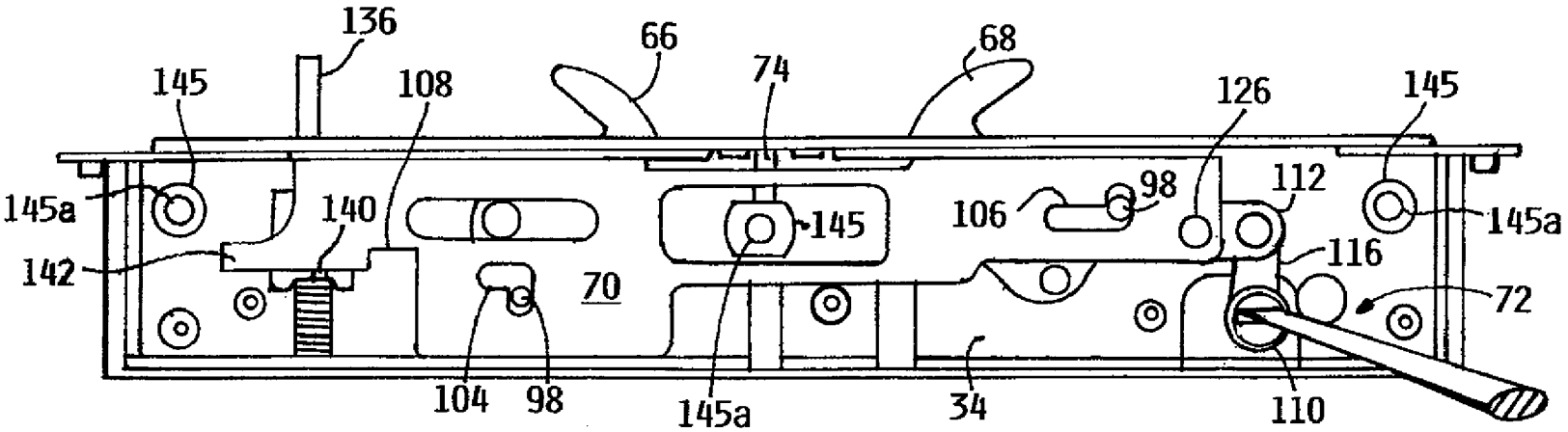
FIG. 8 is a side view of the multi-point latch assembly of FIG. 4 depicting the mechanism at another intermediate position during operation of the latch hooks.
Figure 9:
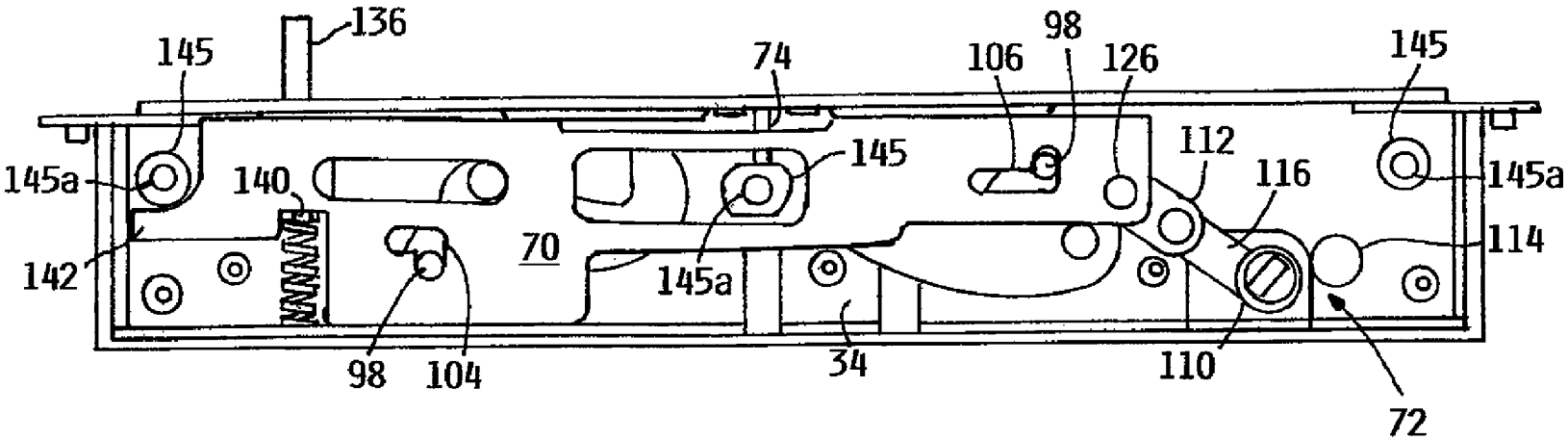
FIG. 9 is a side view of the multi-point latch assembly of FIG. 4 depicting the mechanism at a position during operation of the latch hooks in which the latch hooks are fully retracted.

Hook bolts 66, 68, are selectively positionable between an extended position as depicted in FIG. 4, in which the hook portions 96 project from hook ports 58 to engage a keeper in a door frame, and a retracted portion as depicted in FIG. 9, by rotation of cylinder 110. A sequence of operation is depicted in FIGS. 4 and 7-9. Initially, actuator slide plate 70 at its rightward limit of travel as depicted in FIG. 4. Spring 114 biases cylinder 110 in a clockwise direction and tongue 142 of actuator slide plate 70 rides over projecting tab 140 of block portion 134 of anti slam assembly 76. As cylinder 110 is rotated counter-clockwise against the bias of spring 114, link arm 116 and link 112 urge actuator slide plate 70 leftward. Actuator pins 98 slide in hook actuator slots 104, 106, causing hook bolts 66, 68, to rotate about pivots 100, 102, respectively. Once actuator slide plate 70 nears its leftward limit of travel as depicted in FIG. 9, hook bolts 66, 68, are fully retracted within housing 32. Projecting tab 140 of block portion 134 of anti slam assembly 76 drops into anti-slam notch 108 of actuator slide plate 70 to prevent rightward movement of actuator slide plate 70 unless button 136 is pressed against the bias of spring 138 inward into housing 32. In this position, spring 138 biases cylinder 110 in a counter-clockwise direction. To extend hook portions 96, button 136 can be depressed into housing 32 to disengage projecting tab 140 from anti-slam notch 108, and cylinder 110 can be rotated clockwise.

Figure 18:
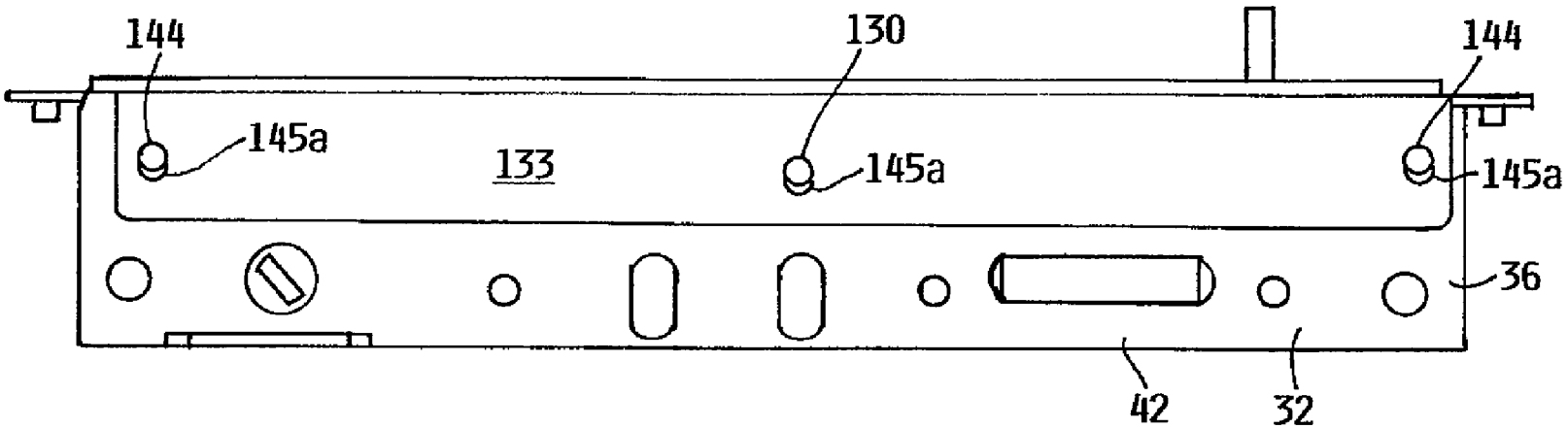
FIG. 18 is an opposing side view of the multi-point latch assembly of FIG. 1.

According to embodiments of the invention, carrier assembly 34 is selectively shiftable within housing 32 to enable adjustment of the distance hook portions 96 project outwardly from front escutcheon plate 40 when fully extended. Posts 144 and post 130 have a larger diameter central portion 145, and a smaller diameter portion 145*a* at both ends. Smaller diameter portion 145*a* of posts 144 and post 130 are fixed to retainer plate 133 which is on the exterior of wall 42 of housing body 36 as depicted in FIG. 18.

Figure 2:
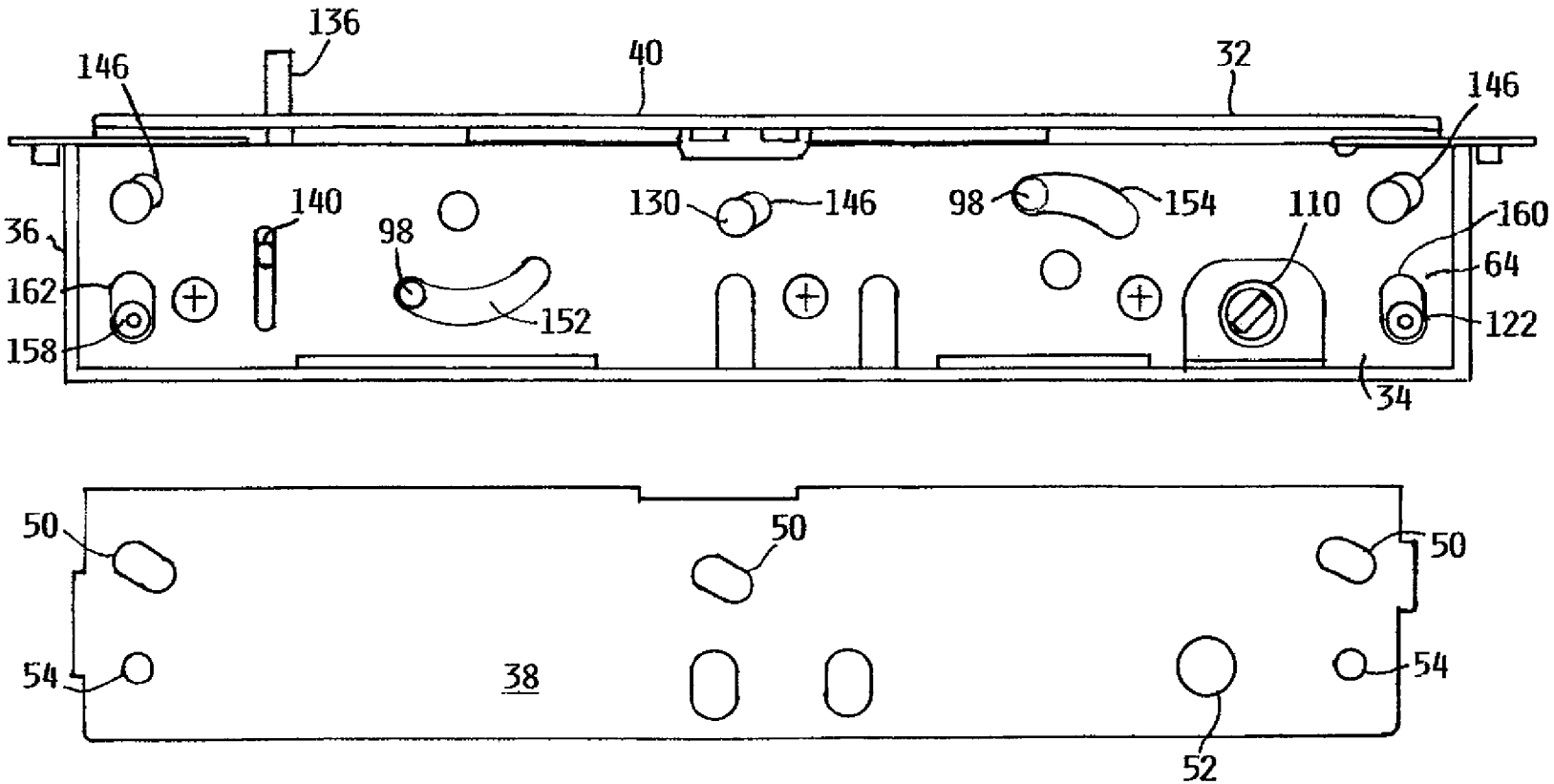
FIG. 2 is a side view of the multi-point latch assembly of FIG. 1 with a portion of the housing removed to expose the carrier assembly and with the latch hooks positioned in a retracted position.

As depicted in FIG. 2, guide slots 50 in cover plate 38 are oriented at an angle relative to front escutcheon plate 40. Carrier housing half 78 defines guide slots 146 which are oriented in a direction generally transverse to the direction of orientation of guide slots 50. Wall 42 of housing body 36 defines guide slots (not depicted) registered with guide slots 50 and oriented in the same direction, while wall 86 of carrier housing half 80 defines guide slots (not depicted) registered with guide slots 146 and oriented in the same direction. Smaller diameter portions 145*a* at the ends of posts 144 and post 130 extend through guide slots 50, 146, and through the corresponding guide slots in wall 42 and wall 86 such that posts 130, 144, are slidable therein. Larger diameter portion 145 of posts 130, 144, is larger than the width of the guide slots in wall 42 and wall 86 so that wall 42 and wall 86 are captured between the larger diameter portions 145 of posts 130, 144, and retainer plate 133 at the edges of the slots with retainer plate 133 being slidable on the outer surface of wall 42.

Carrier housing half 78 is retained on carrier housing half 80 with fasteners 148 that thread through apertures 149 and into bosses 150 extending from carrier housing half 80. Carrier housing half 78 may define arcuate guide slots 152, 154, to receive and guide actuator pins 98 of hook bolt 66, 68, respectively. Further, carrier housing half 78 defines guide slot 156 for guiding projecting tab 140 of anti slam assembly 76. Cover plate 38 is retained on housing body 36 with fasteners 56 threaded into fastener boss 122 and fastener boss 158 which extend from wall 42 of housing body 36. Fastener bosses 122, 158 pass though oblong apertures 160, 162, in carrier housing half 78 and correspondingly registered oblong apertures in wall 86 to enable carrier assembly 34 to shift within housing 32.

Figure 3:
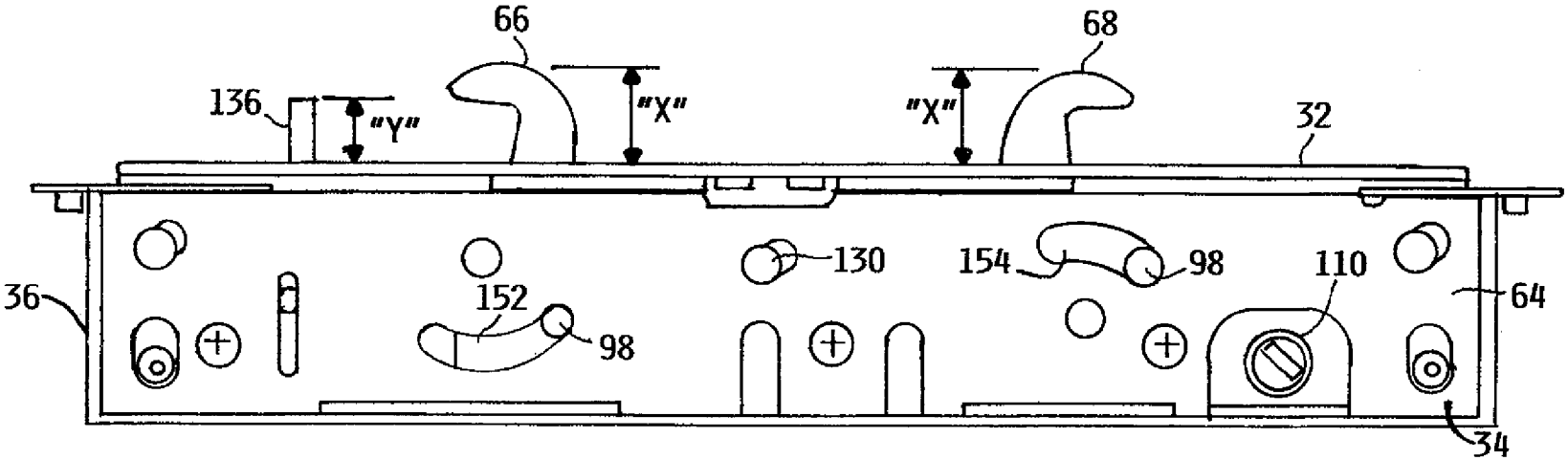
FIG. 3 is a side view of the multi-point latch assembly of FIG. 2 with the latch hooks positioned in an extended position.
Figure 17:
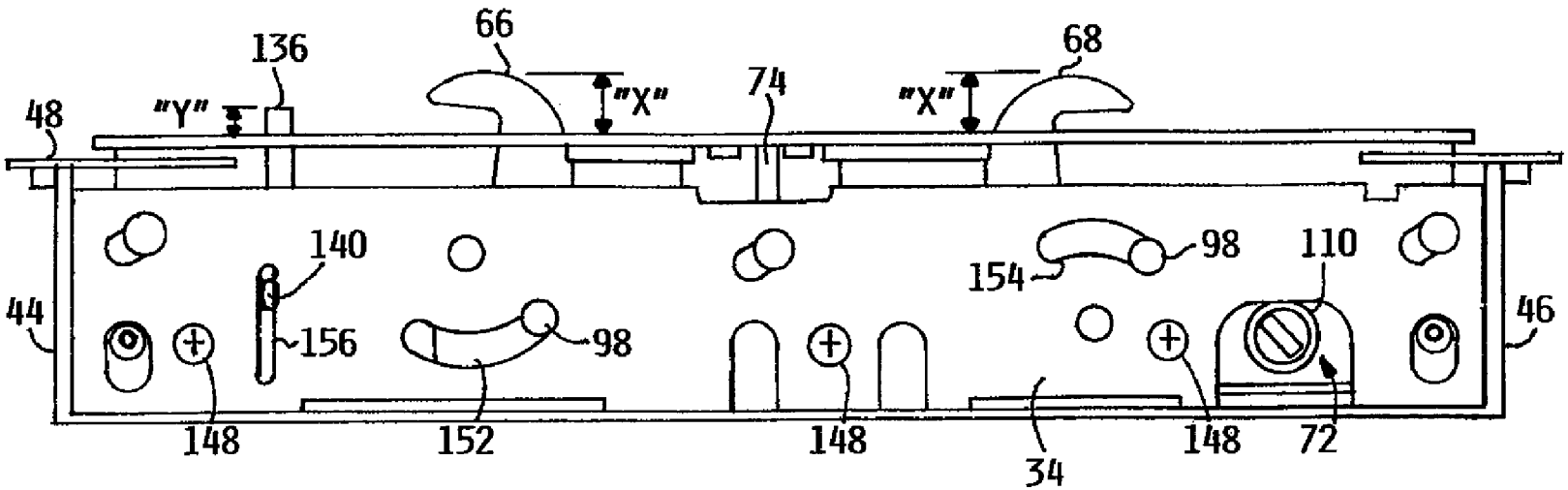
FIG. 17 is a side view of the multi-point latch assembly of FIG. 1 with the carrier positioned in a position away from the front of the housing and the latch hooks in a fully extended position.

In use, the distance "X" by which hook portions 96 extend outwardly from front escutcheon plate 40 can be adjusted at any position between the maximally extended position depicted in FIG. 3, and the maximally retracted position depicted in FIG. 17 with operation of screw 132 of carrier position adjustment assembly 74. With the carrier assembly 34 in the position of FIG. 3, screw 132 is rotated counter-clockwise. Screw 132 threads out of post 130, urging post 130 away from front escutcheon plate 40. Posts 130 and 144 slide in the guide slots 50 and 146. Opposing side walls 90, 92, of carrier assembly 34 abut opposing side walls 44, 46, of housing 34, constraining the movement of carrier assembly 34 only in a direction perpendicular with front escutcheon plate 40. Since retainer plate 133 is slidable on the outer surface of wall 42, however, retainer plate 133 and posts 130, 144, can also shift in a direction generally parallel to front escutcheon plate 40. As a result, in a novel aspect of embodiments of the invention depicted in FIGS. 13 and 14, screw 132 shifts along adjustment screw aperture 60 as screw 132 is turned, thereby providing a visual means for indication of the position of carrier assembly 34 relative to its limits of travel.

In a further novel aspect of embodiments of the invention, anti slam assembly 76 is fully contained in carrier assembly 34. As a result, the distance "Y" by which button 136 protrudes from front escutcheon plate 40 is simultaneously adjustable with screw 132 by the same degree as distance "X" of hook portions 96.

In a further novel feature of embodiments of the invention, handle fastener holes 180, 182, can accommodate door handle set mounting in more than one location relative to latch assembly 30 while retaining cylinder 110 in the same location. Hence, for example, the same latch assembly 30 may be utilized in either the right vertical stile of a sliding door that slides to the right to close, or in the left vertical stile of a sliding door that slides to the left to close, without requiring a different handle set. In addition, different handle sets having different fastener locations relative to the actuator tang location can be used with the same latch assembly 30 having only a single actuator cylinder 110.

Figure 19:
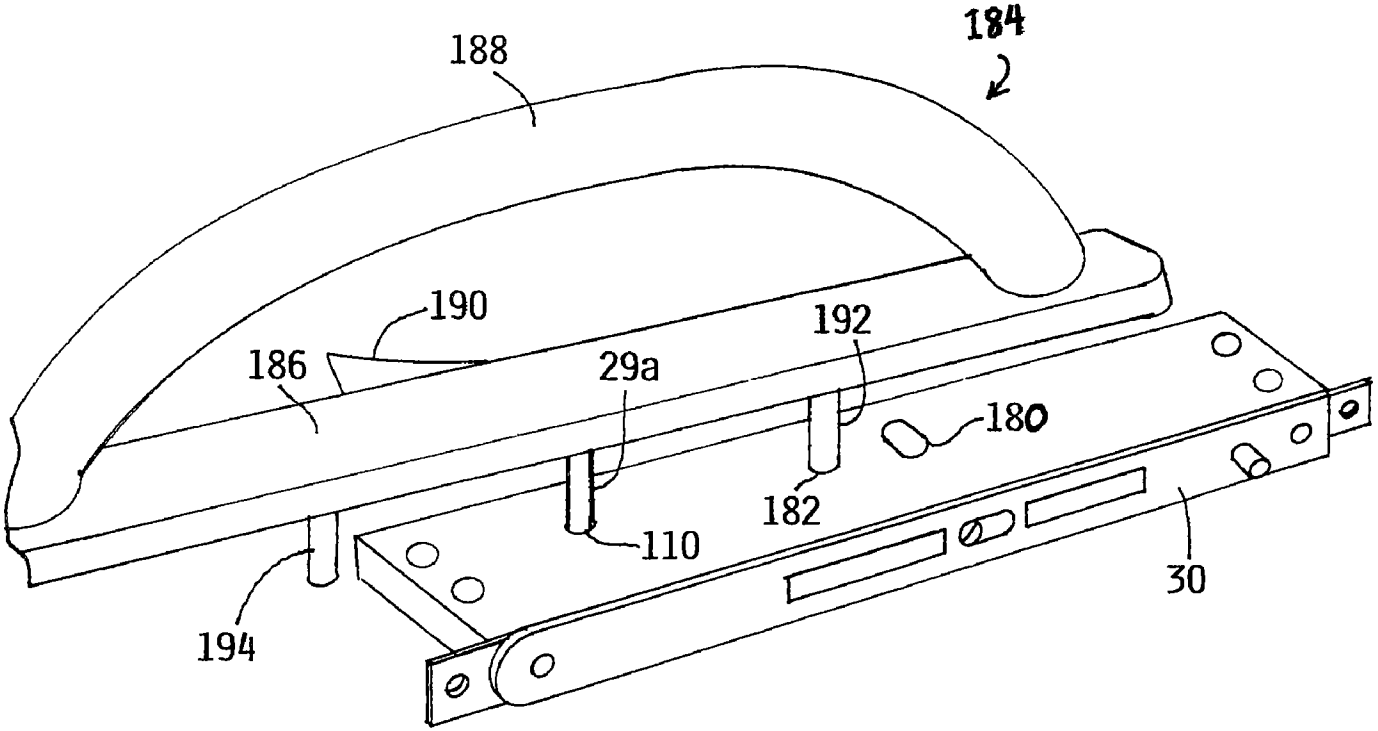
FIG. 19 is a perspective view of a handle set and latch assembly according to an embodiment of the invention.

As depicted in FIG. 19, handle set 184 generally includes handle escutcheon 186 and handle 188. Control lever 190 is operably coupled drive to actuator tang 29*a*, which engages in cylinder 110. Fasteners 192, 194, secure handle set 184 to the sliding door. In FIG. 19, handle set 184 is oriented in a first position relative to latch assembly 30 in which tang 29*a* is engaged with cylinder 110 and fastener 192 passes through fastener hole 182. This orientation of handle set 184 relative to latch assembly 30 might be used, for example, where latch assembly 30 is disposed in the right vertical stile of a door that slides to the right to close. Where handle set 184 is to be used in the left vertical stile of a door that slides to the left to close, however, latch assembly 30 may be simply inverted about its longitudinal axis so that fastener 19 passes through fastener hole 182 from the opposite side. It will also be appreciated that fastener 192 might be spaced a greater distance from tang 29*a* so as to pass through fastener hole 180. In addition, latch assembly 30 might be inverted about a transverse axis so that tang 29*a* is engaged with cylinder 110, but with fastener 194 passing through fastener hole 180 or fastener hole 182. In this way, the same latch assembly 30 can accommodate a wide variety of handle sets oriented in a variety of positions and disposed in either vertical stile of the sliding door.

The embodiments above are intended to be illustrative and not limiting. Additional embodiments are encompassed within the scope of the claims. Although the present invention has been described with reference to particular embodiments, those skilled in the art will recognize that changes may be made in form and detail without departing from the spirit and scope of the invention. For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A sliding door assembly comprising:

a door frame defining an opening;

a door slidably shiftable in a track on the door frame to open and close the opening defined by the door frame, the door including a vertically oriented stile having a mortise in an edge thereof; and a latch assembly received in the mortise, the latch assembly comprising:

a housing;

a carrier assembly received in the housing, the carrier assembly including a carrier member, a pair of spaced apart latch hooks pivotally coupled to the carrier member, each of the latch hooks pivotable about a separate pivot axis, and an actuator linkage operably coupled to the latch hooks, each of the latch hooks being selectively pivotable with the actuator linkage between a first position in which the latch hooks are substantially within the housing and a second position in which a portion of each of the latch hooks protrudes substantially the same distance from the housing to engage the door frame; and a carrier position adjustment assembly operably coupling the housing and the carrier member, the carrier member selectively shiftable in the housing with the carrier position adjustment assembly to simultaneously alter the distance that both of the latch hooks protrude from the housing when the latch hooks are positioned in the second position.

2. The sliding door assembly of claim 1, wherein the carrier assembly further comprises an anti-slam mechanism.

3. The sliding door assembly of claim 2, wherein the anti-slam mechanism includes a button that protrudes from the housing.

4. The sliding door assembly of claim 3, wherein the anti-slam mechanism is shiftable with the carrier position adjustment assembly to alter a distance the button protrudes from the housing.

5. The sliding door assembly of claim 1, wherein the carrier position adjustment assembly comprises a rotatable screw.

6. The sliding door assembly of claim 1, wherein the carrier position adjustment assembly comprises a visual indicator for indicating the position of the carrier assembly relative to the limits of travel of the carrier assembly.

7. The sliding door assembly of claim 6, wherein the carrier position adjustment assembly comprises a rotatable screw, wherein the housing defines an elongate aperture for accessing the rotatable screw, and wherein a position of the rotatable screw within the elongate aperture comprises the visual indicator for indicating the position of the carrier assembly relative to the limits of travel of the carrier assembly.

8. A latch mechanism for a sliding door comprising:

a housing;

a carrier assembly received in the housing, the carrier assembly including a carrier member, a pair of spaced apart latch hooks pivotally coupled to the carrier member, each of the latch hooks pivotable about a separate pivot axis, and an actuator linkage operably coupled to the latch hooks, each of the latch hooks being selectively pivotable with the actuator linkage between a first position in which the latch hooks are substantially within the housing and a second position in which a portion of each of the latch hooks protrudes substantially the same distance from the housing; and a carrier position adjustment assembly operably coupling the housing and the carrier member, the carrier member selectively shiftable in the housing with the carrier position adjustment assembly to simultaneously alter the distance that both of the latch hooks protrude from the housing when the latch hooks are positioned in the second position.

9. The latch assembly of claim 8, wherein the carrier assembly further comprises an anti-slam mechanism.

10. The latch assembly of claim 9, wherein the anti-slam mechanism includes a button that protrudes from the housing.

11. The latch assembly of claim 10, wherein the anti-slam mechanism is shiftable with the carrier position adjustment assembly to alter a distance the button protrudes from the housing.

12. The latch assembly of claim 8, wherein the carrier position adjustment assembly comprises a rotatable screw.

13. The latch assembly of claim 8, wherein the carrier position adjustment assembly comprises a visual indicator for indicating the position of the carrier assembly relative to the limits of travel of the carrier assembly.

14. The latch assembly of claim 13, wherein the carrier position adjustment assembly comprises a rotatable screw, wherein the housing defines an elongate aperture for accessing the rotatable screw, and wherein a position of the rotatable screw within the elongate aperture comprises the visual indicator for indicating the position of the carrier assembly relative to the limits of travel of the carrier assembly.

* * * * *

UNITED STATES PATENT AND TRADEMARK OFFICE

CERTIFICATE OF CORRECTION

PATENT NO. : 8,376,414 B2
APPLICATION NO. : 12/098139
DATED : February 19, 2013
INVENTOR(S) : Yoshikazu Nakanishi et al.

It is certified that error appears in the above-identified patent and that said Letters Patent is hereby corrected as shown below:

In the Specification

Column 5, Line 44:
Delete "Anti slam" and insert --Anti-slam--.

Column 5, Line 55:
Delete "slide plate 70 at" and insert --slide plate 70 is at--.

Column 5, Line 59:
Delete "anti slam" and insert --anti-slam--.

Column 5, Line 67:
Delete "anti slam" and insert --anti-slam--.

Column 6, Line 42:
Delete "anti slam" and insert --anti-slam--.

In the Claims

Column 8, Line 3, Claim 1:
Delete "separate" and insert --respective--.

Column 8, Line 14, Claim 1:
After "position adjustment", insert --assembly, the carrier position adjustment assembly having an adjustment mechanism that is operably coupled with the carrier member at a single point on the carrier member--.

Signed and Sealed this
Third Day of June, 2014

Michelle K. Lee

Michelle K. Lee
*Deputy Director of the United States Patent and Trademark Office*

Column 8, Line 27, Claim 5:
After "claim 1, wherein the" insert --adjustment mechanism of the--.

Column 8, Line 33, Claim 7:
After "claim 6, wherein the" insert --adjustment mechanism of the--.

Column 8, Line 45, Claim 8:
Delete "separate" and insert --respective--.

Column 8, Line 56, Claim 8:
After "position adjustment", insert --assembly, the carrier position adjustment assembly having an adjustment mechanism that is operably coupled with the carrier member at a single point on the carrier member--.

Column 9, Line 1, Claim 12:
After "claim 8, wherein the" insert --adjustment mechanism of the--.

Column 9, Line 7, Claim 14:
After "claim 13, wherein the" insert --adjustment mechanism of the--.